US005188469A

United States Patent [19]

Nagao et al.

[11] Patent Number: 5,188,469

[45] Date of Patent: * Feb. 23, 1993

[54] TAPE FEED CASSETTE WITH TAPE CUTTER AND GUIDE

[75] Inventors: Yoshiaki Nagao, Tsushima; Atsuhiro Kobayashi, Nagoya; Mikio Sakuma, Ichinomiya, all of Japan

[73] Assignee: Brother Kogyo Kabushiki Kaisha, Aichi, Japan

[ * ] Notice: The portion of the term of this patent subsequent to May 22, 2007 has been disclaimed.

[21] Appl. No.: 737,927

[22] Filed: Jul. 29, 1991

Related U.S. Application Data

[63] Continuation of Ser. No. 421,976, Oct. 16, 1989, abandoned.

[30] Foreign Application Priority Data

Oct. 14, 1988 [JP] Japan ..... 63-260173

[51] Int. Cl.[5] ..... B41J 15/24

[52] U.S. Cl. ..... 400/615.2; 400/120; 400/188; 400/208; 400/621; 156/387

[58] Field of Search ..... 400/621, 613, 208, 208.1, 400/207, 695, 696, 697.1, 134.5, 136, 615.2, 236, 236.2, 120, 188, 611; 101/288; 156/384–387

[56] References Cited

U.S. PATENT DOCUMENTS

| | | | |
|---|---|---|---|
| 3,823,808 | 7/1974 | Murata et al. | 400/611 |
| 4,402,619 | 9/1983 | Paque et al. | 400/36 |
| 4,419,175 | 12/1983 | Bradshaw et al. | 156/554 |
| 4,557,617 | 12/1985 | Richardson et al. | 400/208 |
| 4,700,976 | 10/1987 | Loose | 156/384 |
| 4,773,775 | 9/1988 | Bradshaw et al. | 400/208 |
| 4,844,636 | 7/1989 | Paque | 400/613 |
| 4,917,514 | 4/1990 | Richardson et al. | 400/208 |
| 4,927,278 | 5/1990 | Kuzuya et al. | 400/207 |

FOREIGN PATENT DOCUMENTS

| | | | |
|---|---|---|---|
| 0141412 | 5/1985 | European Pat. Off. . | |
| 0272232 | 6/1988 | European Pat. Off. | 400/613 |
| 0322928 | 5/1989 | European Pat. Off. . | |
| 0322918A3 | 7/1989 | European Pat. Off. . | |
| 0322918A2 | 7/1989 | European Pat. Off. . | |

OTHER PUBLICATIONS

European Search Report EP 8931 0581.
US Ser. No. 291,286 filed on Dec. 28, 1988.
US Ser. No. 291,143 filed on Dec. 28, 1988.
Communication and attached European Search Report Application No. EP 92104562.
European Search Report Application No. EP 88121862.

*Primary Examiner*—Edgar S. Burr
*Assistant Examiner*—Stephen R. Funk
*Attorney, Agent, or Firm*—Kane, Dalsimer, Sullivan, Kurucz, Levy, Eisele and Richard

[57] ABSTRACT

In a tape feed mechanism comprising a tape storage cassette including at least two tapes in respective wound states and a tape feed device feeding the two tapes in an overlapped state, provided is a guide member for guiding the two tapes to a predetermined portion in the tape storage cassette. Thus, the tape storage cassette is detachably mounted from the tape feed device in a condition that each of the leading end portions of the tapes are fixed at the predetermined position and the tape storage cassette is attachably mounted again to the tape feed device in that condition.

10 Claims, 3 Drawing Sheets

TAPE FEED CASSETTE WITH TAPE CUTTER AND GUIDE

This is a continuation of co-pending application Ser. No. 421,976 filed on Oct. 16, 1989, now abandoned.

BACKGROUND OF THE INVENTION

The present invention relates to a tape feed mechanism including a tape storage cassette for housing at least two tapes whose widths are nearly the same, the tapes being overlapped and cut. More particularly, the invention relates to a tape feed mechanism capable of feeding the two tapes to a predetermined position in an overlapped state.

Apparatus for printing characters on a non-adhesive side of an adhesive tape has been well-known. In this type of apparatus, although characters such as names can be printed on tapes which can be suitably adhered on the desired matters, the printed characters are erased or become blurred because the printed surface is exposed. To solve such a problem, disclosed is an apparatus for making printed tapes where the printed surface is not exposed in Japanese Patent Application No. SHO62-294471 and so forth. With this apparatus characters are reversely printed on a transparent film tape and a double-sided adhesive tape of the same width thereof is adhered thereon.

However, in such apparatus, because the film tape where characters are printed and the double-sided adhesive tape which is adhered thereon are separately mounted on the apparatus, it is not easy to attach and detach the tapes. To solve this problem, it is possible to attach a cassette which cooperatively houses the tapes to the printing apparatus. However, the tapes cannot be effectively attached to the printing apparatus only by simply housing the tapes in the cassette. Since the tapes are arranged and connected outside the cassette after characters are printed on the film tape, if both the tapes are housed in the cassette and the ends of the tapes are extended to the outside, whenever the cassette is attached to the printing apparatus, it is necessary to arrange the ends of the tapes and guide them to the connection portion, whereby the attaching operation becomes difficult.

SUMMARY OF THE INVENTION

It is therefore an object of the invention to provide an improved tape feed mechanism capable of guiding the overlapped tapes to a certain portion and being arranged to be detached from the tape moving apparatus having a cutting apparatus, the tapes are held at the connection position being outwardly taken out.

For this purpose, according to this invention, there is provided a tape feed mechanism comprising a tape holding case including at least two tapes in respective wound states and being attachably and detachably mounted on a tape feed device having a cutting member for cutting the tapes and a feed roller member for feeding one of the two tapes, the tape feed mechanism comprises a guide member provided on the tape holding case for guiding the two tapes toward a predetermined position in the tape holding case in an overlapped state.

DESCRIPTION OF THE ACCOMPANYING DRAWINGS

DESCRIPTION OF THE EMBODIMENT

The tape holding case incorporating the present invention is now described below with reference to the accompanying drawings.

Figure 1:
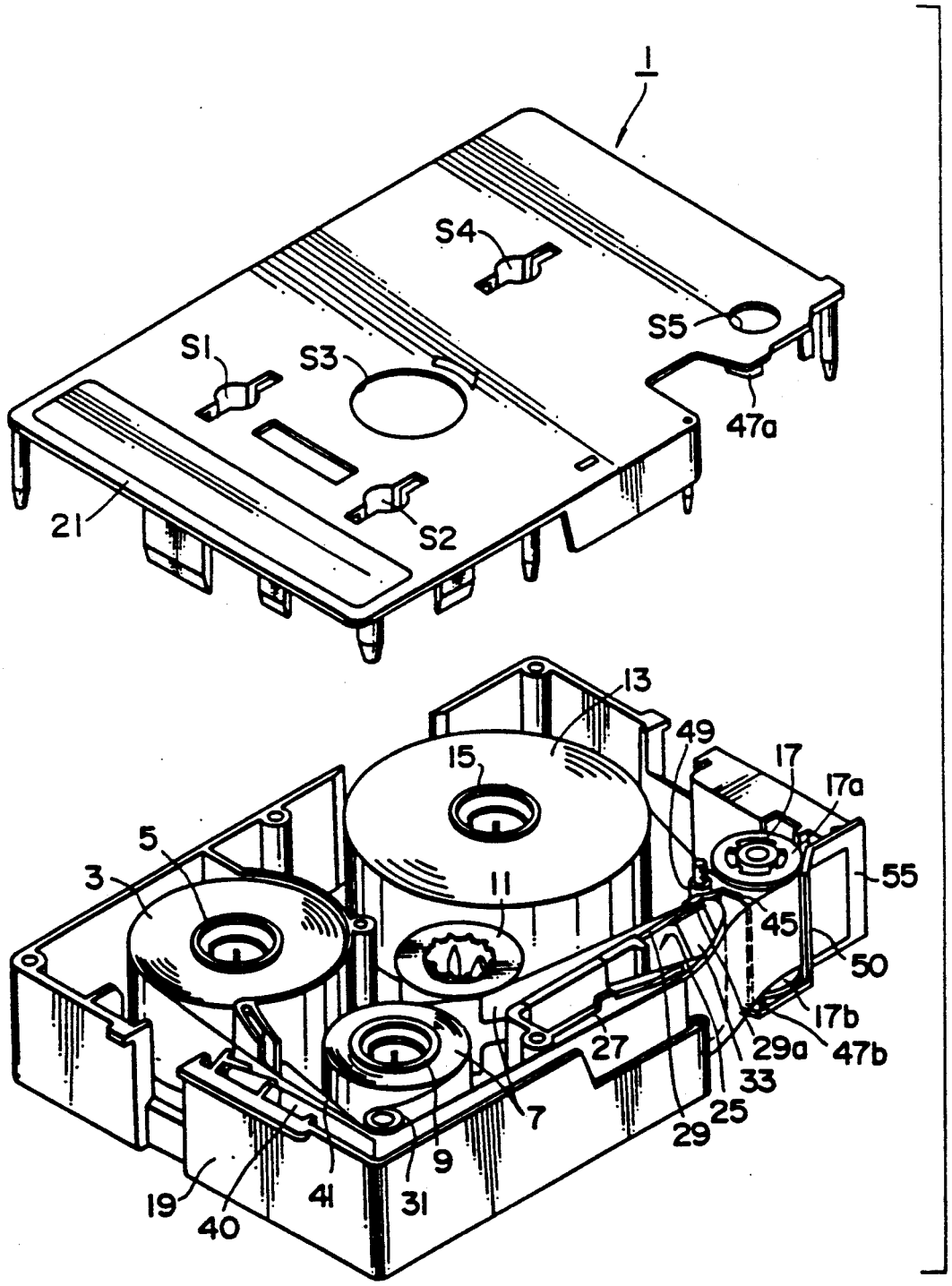
FIG. 1 is a perspective view of the tape storage cassette embodying the present invention.

As shown in the disassembled perspective view of FIG. 1, a tape storage cassette 1 according to this embodiment includes a film tape spool 5 around which a transparent film tape 3 is fitted, a ribbon feed spool 9 having a thermal transfer ribbon 7 wound thereon with its inked surface facing inside, a ribbon takeup spool 11 taking up the thermal transfer ribbon 7 drawn out of the ribbon feed spool 9, a double-sided adhesive tape spool 15 on which a double-sided adhesive tape 13 narrower than the film tape 3 and having one surface covered with an exfoliative sheet is wound with this sheet covered surface facing outside, and an alignment roller 17 for alignment of the double-sided adhesive tape 13 and the film tape 3, all of which are stored in a cassette case 19. They are rotatably carried by support members S1 through S5 mounted on a cover 21 and on the bottom of the cassette case 19 opposed to the cover 21 within the cassette case 19 whose opening is covered with the cover 21.

The tape storage cassette 1 is attachably and detachably mounted on a printer unit capable of reverse-printing desired characters. Thus, the unit accomplishes reverse-printing on the film tape 3 using the thermal transfer ribbon 7. The double-sided adhesive tape 13 is then stuck to the printed surface to provide a print tape with desired characters already printed.

Figure 2:
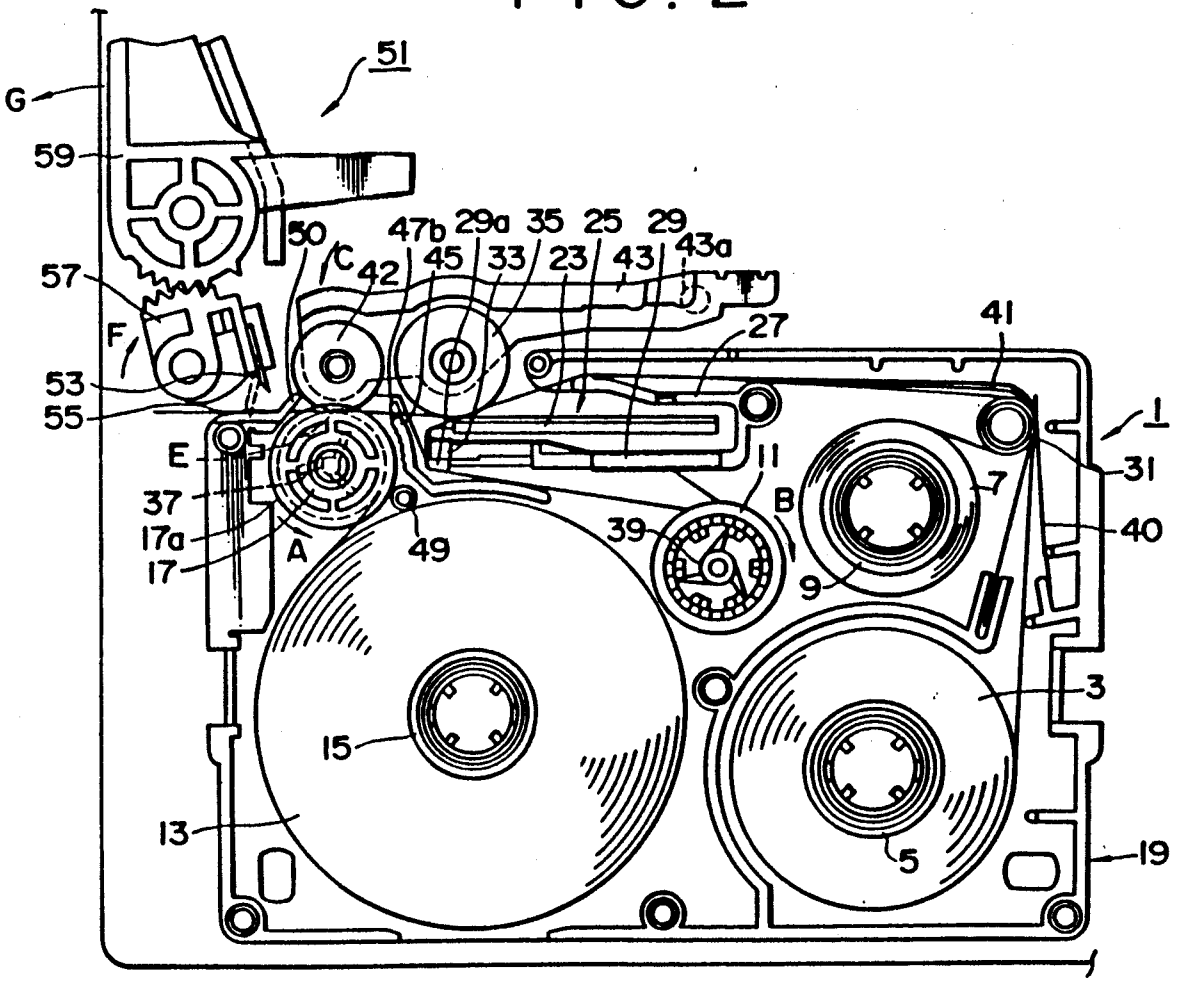
FIG. 2 is an explanatory view showing the tape storage cassette of FIG. 1 attached to the printer unit, and FIG 3. is another explanatory view of the tape storage cassette according to another embodiment.

The tape storage cassette case 1 is formed with a recess 25 to receive a thermal head 23 mounted on the printer unit as shown in FIG. 2. Along the inner and outer periphery of the recess 25 provided are upright extending guide plates 27 and 29 to define a space for receiving the thermal head 23. FIG. 2 represents the tape storage cassette 1 fitted in the printer unit, so that the following description will be made with reference mainly to this drawing. The film tape 3 and the thermal transfer ribbon 7 with its inside surface coated with ink face across each other and are guided together to the recess 25 by means of a guide pin 31. Guide plates 27 and 29 form a restricting path for the film tape 3 and the thermal transfer ribbon 7 sent to the recess 25 to avoid their blocking the space accommodating the thermal head 23.

The guide plate 29 extending upright from the inner periphery of the recess 25 is provided with a leaf spring 33 loading the film tape 3 and the thermal transfer ribbon 7 outward to thereby ensure a required space for receiving the thermal head 23.

When the tape storage cassette 1 is attached to the printer unit, the thermal head 23 is thus located behind the thermal transfer ribbon 7. The film tape 3 and the thermal transfer ribbon 7 are then pressed against the thermal head 23 by means of a platen roller 35 provided on the printer unit and movable into and out of engagement with the thermal head 23, whereby desired reverse characters can be printed on the film tape 3.

The thermal transfer ribbon 7 passed through the recess 25 is taken up onto the ribbon takeup spool 11 via an end **29*a* of the guide plate 29. At the same time, the film tape 3 is drawn out of the cassette 1 by means of the alignment roller 17. When attached to the printer unit, the alignment roller 17 and the ribbon takeup spool 11 are respectively splined to a tape feed element 37 and a ribbon takeup element 39** on the printer unit which are driven for rotation in opposite directions by a drive motor and power transmission mechanism, not shown, and are rotatably driven by these elements in the directions indicated by arrows A and B.

The thermal transfer ribbon 7 and the film tape 3 thus travel along the path consisting of guide pin 31, guide plate 27 and recess 25 by such rotary drive motion. Inertia of such rotary motion however causes an extra amount of thermal transfer ribbon 7 and film tape 3 to be drawn from the respective spools 5 and 7. This results in slack of the ribbon 7 and the tape 3 in the recess 25, making it impossible to accomplish a proper reverse-printing action on the film tape 3. To overcome this problem, the present tape storage cassette 1 is provided with a leaf spring 40 mounted near the guide pin 31, which pressingly biases the thermal transfer ribbon 7 and the film tape 3 from outside. The thermal transfer ribbon 7 and the film tape 3 are thus loaded with back tension to prevent the thermal transfer ribbon 7 and the film tape 3 from being slackened at the recess 25. Furthermore, there is provided a separator film 41 which protects the film tape 3 from ink coating on the thermal transfer ribbon 7 while traveling along the feed path between the position at which the film tape 3 is drawn from the film tape spool 5 and the recess 25. The film tape 3 and the thermal transfer ribbon 7 are given back tension independently of each other by means of the separator film 41 and the leaf spring 40 so that, even if one of the film tape 3 and the thermal transfer ribbon 7 is drawn out for some reason, such pulling action would not affect normal feed motion of the remaining one of the tapes.

The alignment roller 17 not only brings the film tape 3 and the double-sided adhesive tape 13 into alignment but also is operatively associated with a feed roller 42 on the printer unit movable into and out of engagement with the alignment roller 17 to press the adhesive surface of the double-sided adhesive tape 13 against the print surface of the film tape 3 so as to bond the both tapes together. As shown in FIG. 1, the alignment roller 17 is at its both ends provided with flanges **17*a* and 17*b* mounted at right angles to the roller surface so as to restrict widthwise movement of the both tapes 3 and 13. The feed roller 42 is carried by a support member 43 mounted on the printer unit for rotation about an axis 43*a*. With the tape storage cassette 1 attached to the printer unit, the support member 43 is biased in the direction indicated by an arrow C by means of biasing means not shown, so that the film tape 3 and the double-sided adhesive tape 13 are pressed against the roller surface of the alignment roller 17** for bonding the tapes together.

The support member 43 carrying the feed roller 42 on the printer unit also carries the platen roller 35 thereon, so that the platen roller 35, like feed roller 42, biases the support member 43 in the direction indicated by the arrow C to press the film tape 3 and the thermal transfer ribbon 13 against the thermal head 23. The platen roller 35 is like the feed roller 42 also in that it is formed by a resilient material such as rubber to avoid scratches at film tape 3 during pressing and to provide a required resistance and friction force.

In the feed path of film tape 3 from the recess 25 to the alignment roller 17 provided is a guide plate 45 for guiding the film tape 3 to a joint position E with the double-sided adhesive tape 13 on the alignment roller 17. The guide plate 45 is at both ends, i.e., at the cover 21 and the cassette case 19 shown in FIG. 1, provided with restricting elements **47*a* and 47*b* for restriction of widthwise displacement of the film tape 3. Since the length of the travel path of the film tape 3 is longer than that of the double-sided adhesive tape 13, it is considered that the film tape 3 is aligned in a width direction before it is overlapped with the double-sided adhesive tape 13 by means of the feed roller 42 and the alignment roller 17**.

The feed path of the double-sided adhesive tape 13 to the alignment roller 17 includes a guide roller 49 made of silicon resin to prevent the double-sided adhesive tape 13 from sticking to other parts such as thermal transfer ribbon 7 in the cassette 1. The double-sided adhesive tape 13 passed through this path is then guided to the joint position E with the film tape 3 by the roller surface of the alignment roller 17.

The film tape 3 and the double-sided adhesive tape 13 thus joined together by the alignment roller 17 and the feed roller 42 (i.e., print tape) are guided out of the cassette 1 by way of a tape holder 50 provided at the exit. The tape travel path outside the cassette case 19 is provided with a block 55 for receiving a cutting blade 53 in a tape cutter 51 mounted on the printer unit. The print tape thus completed is then cut off by pressing the cutting blade 53 against the block 55 by operation of the tape cutter 51. The tape cutter 51 is rotatably mounted on the printer unit and consists of a cutting blade holder 57 carrying the cutting blade 53 and a rotary arm 59 for rotating the cutting blade holder 57 in the direction indicated by an arrow F. The print tape is cut off by manually moving the rotary arm 59 in the direction indicated by an arrow G.

The tape storage cassette 1 according to the present embodiment is provided with the alignment roller 17 which arranges and connects the film tape 3 and the double-sided adhesive tape 13 and with the block 55 which receives the cutting blade 53 which cuts the printed tape made by the connection therewith. When the printed tape is made by mounting the film tape 3 and the double-sided adhesive tape 13, they are connected and cut by the cooperating operations of the alignment roller 17, the block 55, and the feed roller 42 and the tape cutter 51 provided on the printer. In the cassette case 19, the film tape 3 is guided to the connection position E by the operations of the guide pin 31, the guide plate 27, and the guide plate 45, the double-sided adhesive tape 13 being guided to the connection position E by the operations of the guide roller 49 and the roller surface of the guide roller 49, the printed tape which are connected being guided to the position of the block 55 which is the tape cutting position through the tape holder 50.

When the tape storage cassette 1 is detached from the printer and another tape storage cassette housing a different color thermal transfer ribbon is attached so as to make a different color printed tape, by separating the platen roller 35 and the feed roller 42 from the tape storage cassette 1, the tape storage cassette 1 can be directly detached in the condition that the film tape 3 and the double-sided adhesive tape 13 are guided to the connection position E. When the tape storage cassette 1 is attached to the printing apparatus again, it is not necessary to manually guide each tape to the connection position E. In addition, since the tapes are connected from the connection position E to the cutting position, it is not necessary to arrange and connect both the tapes 3 and 13 when attaching the tape storage cassette 1 to the printer, thereby simplifying the attaching operation. Moreover, in the cassette case 19, since the film tape 3 is tensioned by the leaf spring 40 in the position of the guide pin 31, when the tape storage cassette 1 is detached from the printer, the connection portion of the film tape 3 and the double-sided adhesive tape 13 is not outwardly extended, whereby it is possible to keep the tape holding case 1 in the condition that each tape is dismounted from the printer.

Figure 3:
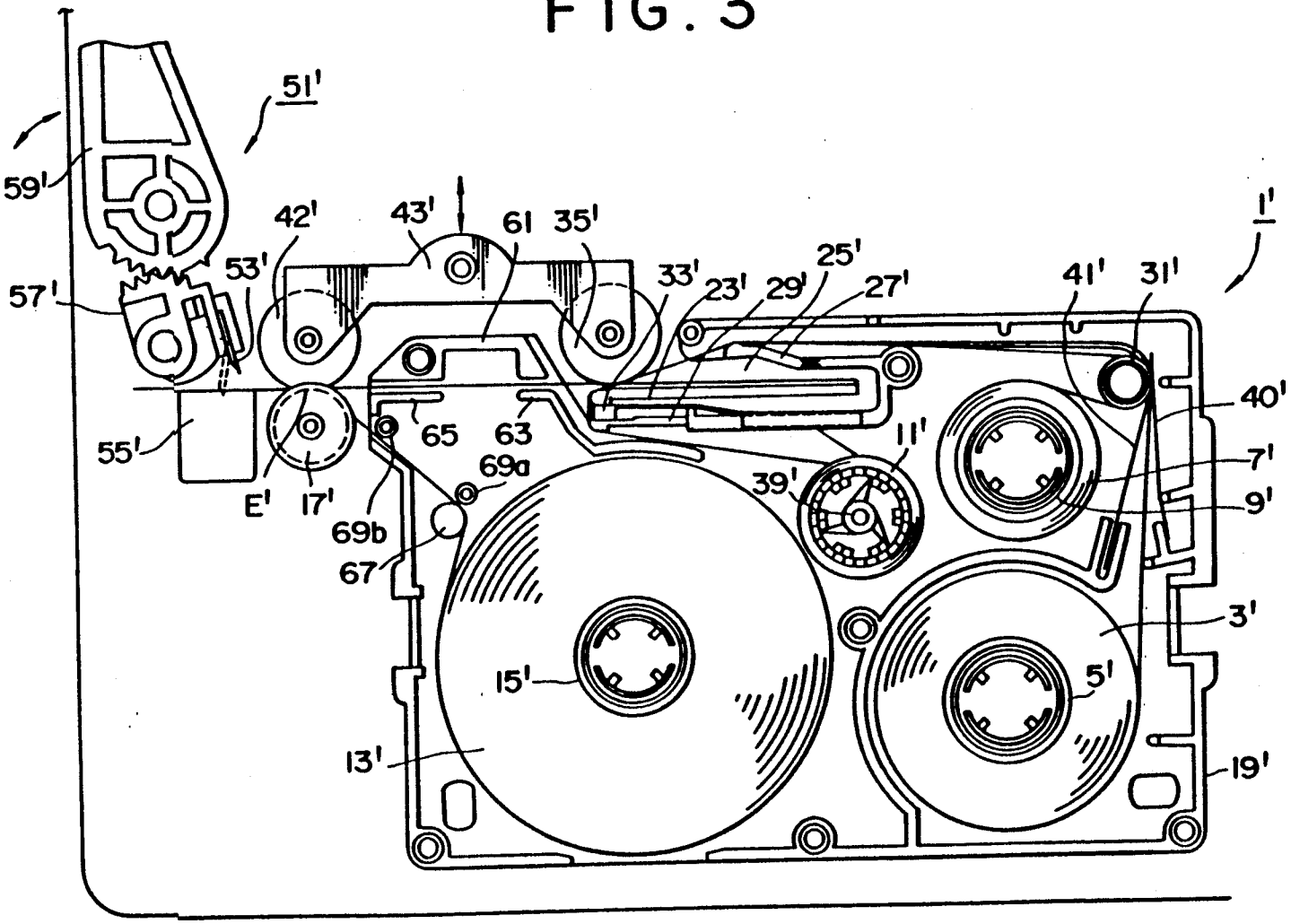

In the above embodiment, the tape storage cassette 1 which is provided with the alignment roller 17 and the block 55 of the cutting blade 53 has been described. However, even if such portions are provided on the printing apparatus it is described in the following. In FIG. 3, the portions same as those in the above embodiment are referred to as the same numbers with "'".

As shown in FIG. 3, printer to which a tape storage cassette 1' is attached is provided with an alignment roller 17' and a block 55' of a cutting blade 53', a film tape 3' and a double-sided adhesive tape 13' taken out from the tape storage cassette 1' being arranged, pressured and cut by the printer.

Therefore, in the tape storage cassette 1' of the second embodiment, guide plates 63 and 65 are provided from a concavity 25' to a take out opening of the film tape 3' so as to form a traveling path of the film tape 3' against an outer wall 61 of a cassette case 19', thereby guiding the film tape 3' to the connection position E' with the double-sided adhesive tape 13' on the alignment roller 17'.

The traveling path of the double-sided adhesive tape 13' is formed by a guide pin 67 disposed on an exfoliative sheet side of the double-sided adhesive tape 13', the outer wall of the cassette case 19', and two guide rollers **69*a* and 69*b* made of silicone resin disposed on the adhesive side of the double-sided adhesive tape 13'. By guiding the double-sided adhesive tape 13' along the traveling path, it can be guided to the connection position E' with the film tape 3' on the alignment roller 17'**.

Consequently, in the second embodiment, the tape storage cassette 1' can be detached from the printing apparatus in the condition the film tape 3' and the double-sided adhesive tape 13' are guided to the connection position E', thereby simplifying the attaching operation thereof.

What is claimed is:

1. A tape feed mechanism comprising a tape feed device and a tape holding case;

said tape holding case including: means to detachably mount said case to said tape feed device; a wound printing tape and a wound double sided adhesive tape, said tapes being disposed for movement within said case along respective paths, said paths joining at a common point at which said tapes are overlapped and and adhesive layer on a surface of said adhesive tape is adhesively secured to said printing tape, said adhesive tape having an exfoliate sheet on a surface opposite the surface that contacts said printing tape;

said tape feed device including means for moving said tapes; a tape print member along the path of movement of said printing tape for printing on a surface of said printing tape and a cutting member downstream of said common point; and guide member means provided on said tape holding case for restricting widthwise displacement of said printing tape, for guiding said two tapes to overlap and for pressing said adhesive tape against said printing tape.

2. A tape feed mechanism comprising a tape feed device and a tape holding case;

said tape holding case including: means to detachably mount said case to said tape feed device; a wound printing tape and a wound adhesive tape having an adhesive layer on one surface thereof, said tapes being disposed for movement within said case along respective paths, said paths joining at a common point at which said tapes are overlapped and said adhesive layer of said adhesive tape is adhesively secured to said printing tape;

said tape feed device including means for moving said tapes; a tape print member along the path of movement of said printing tape for printing on a surface of said printing tape and a cutting member downstream of said common point; and guide member means provided on said tape holding case for restricting widthwise displacement of said printing tape, for guiding said two tapes to overlap and for pressing said adhesive layer of said adhesive tape against said printing tape;

adjust means for adjusting a position of said adhesive tape in a direction perpendicular to a direction along which said adhesive tape is fed, said adjust means comprising a roller member provided on said tape holding case and having a circumferential surface disposed to be brought into and out of contact with said adhesive layer of the adhesive tape, said circumferential surface being formed of a material having a low coefficient of adhesion so as not to adhere to said adhesive layer when said circumferential surface and said adhesive layer are brought into contact with each other.

3. The tape feed mechanism according to claim 2 wherein said roller member is made of a silicon resin.

4. A printing device for executing printing operations onto a tape-like recording medium, said printing device comprising:

a housing;

a cassette case member having means for detachably mounting said case member to said housing for accomm dating said tape-like recording medium in a wound state and including a transfer ribbon through which printing operations are executed onto said tape-like recording medium and a double-sided adhesive tape, said case member further comprising means for overlapping said double-sided adhesive tape and said tape-like recording medium on which printing operations have been executed;

print member means for printing desired character and/or symbol data onto a predetermined surface of said tape-like recording medium;

tape feeding means for feeding said tape-like recording medium on which printing operations have been executed;

a wall of said cassette case member;

a supporting member;

a cutter blade movably supported by said supporting member for cutting said tape-like recording medium, said cutter blade being disposed to contact said wall of said cassette case member through said tape-like recording medium upon movement of said supporting member whereby said tape-like recording medium is cut by said cutter blade as said supporting member is move.

5. The printing device according to claim 4, wherein said tape-like recording medium comprises a transparent film tape.

6. The printing device according to claim 5, wherein said printing member means executes reverse-printing on a surface of said transparent film tape, whereby the printed character and/or symbol data on said surface can be normally viewed from the opposite surface thereof and said transparent film tape can be adhered to a desired material through said double-sided adhesive tape.

7. The printing device according to claim 6 further comprising an exfoliative sheet covering a surface of said double-sided adhesive tape opposite to that on which said transparent film tape is adhered.

8. The printing device in accordance with claim 4 wherein said feeding means comprises a feeding roller for feeding said tape-like recording medium and a guide pin for aligning said tape-like recording medium along a predetermined portion of a wall of said cassette case.

9. The printing device according to claim 8, wherein said tape feed means feeds said tape-like recording medium toward the outside of said cassette case member along a path parallel to an outer surface of said cassette case member.

10. The operating device according to claim 9, wherein said cutter means is rotatably supported by said supporting member which is provided on said housing.

* * * * *